US005242783A

United States Patent [19]

Buchanan et al.

[11] Patent Number: 5,242,783

[45] Date of Patent: Sep. 7, 1993

[54] PHOTOGRAPHIC MATERIAL AND PROCESS

[75] Inventors: John M. Buchanan; Gary S. Proehl, both of Rochester, N.Y.

[73] Assignee: Eastman Kodak Company, Rochester, N.Y.

[21] Appl. No.: 919,421

[22] Filed: Jul. 23, 1992

Related U.S. Application Data

[63] Continuation-in-part of Ser. No. 739,117, Jul. 31, 1991, abandoned.

[51] Int. Cl.[5] ..... G03C 7/26; G03C 1/42; G03C 1/34; G03C 1/06

[52] U.S. Cl. ..... 430/446; 430/376; 430/380; 430/219; 430/223; 430/543; 430/558; 430/559; 430/562; 430/564; 430/566; 430/598; 430/611; 430/613; 430/628; 430/955; 430/957; 430/958; 430/959; 430/544

[58] Field of Search ..... 430/955, 957, 959, 223, 430/219, 443, 543, 548, 376, 380, 434, 558 R, 559, 562, 564, 566, 598, 611, 613, 628, 958, 558 A, 446, 544

[56] References Cited

U.S. PATENT DOCUMENTS

| | | | |
|---|---|---|---|
| 4,310,612 | 1/1982 | Mooberry et al. | 430/223 |
| 4,435,495 | 3/1984 | Lau | 430/219 |
| 4,690,885 | 9/1987 | Yagihara et al. | 430/544 |
| 4,847,185 | 7/1989 | Begley et al. | 430/376 |
| 5,019,492 | 5/1991 | Buchanan | 430/544 |

*Primary Examiner*—Richard L. Schilling
*Attorney, Agent, or Firm*—Arthur E. Kleugel

[57] ABSTRACT

A novel blocked photographically useful compound element and process are based on a new blocking group that comprises a beta-ketocarbonyl group that is part of a 5- to 7-member heterocyclic ring containing a hetero-atom not adjacent to the beta-ketocarbonyl group. Such a blocked photographically useful compound provides a photographic material and process enabling more rapid release of the photographically useful group upon processing.

10 Claims, No Drawings

PHOTOGRAPHIC MATERIAL AND PROCESS

Cross-reference to Related Application

This application is a continuation-in-part of U.S. Ser. No. 739,117, filed Jul. 31, 1991, now abandoned.

BACKGROUND OF THE INVENTION

This invention relates to a new photographic element containing a novel blocked photographically useful compound that is capable of more rapidly releasing the photographically useful group of the compound upon photographic processing.

Various compounds, such as couplers and dyes, are known in the photographic art that contain a blocking group and that are capable of being released or unblocked upon processing of the photographic material containing the compound. Such compounds and various blocking groups have been described in, for example, U.S. Pat. Nos. 4,690,885; 4,358,525 and 4,554,243 and U.S Pat. No. 5,019,492. While these compounds have enabled increased storage stability compared to compounds that are not blocked and have provided release of the photographically useful group from the compound upon processing, often the stability of the compounds during storage prior to exposure and processing of the photographic materials containing the compounds has not been entirely satisfactory and the rate of release or unblocking of the compound has been less than desired.

A continuing need has existed for a blocked photographically useful compound containing a blocking group that enables a means of tailoring the ballasting of such compounds without adverse effects upon a photographic material.

SUMMARY OF THE INVENTION

The photographic element of the invention comprises a support bearing at least one silver halide photographic emulsion layer and a blocked photographically useful compound comprising a photographically useful group and a blocking group that is capable of releasing the photographically useful group upon processing the photographic element. The blocking group contains a beta-ketocarbonyl group that is part of a 5 to 7 member heterocyclic ring containing a nitrogen, sulfur, selenium or oxygen heteroatom located at a position not adjacent to the betaketocarbonyl group. The invention also encompasses the photographically useful compound and the photographic process employing the element.

DETAILED DESCRIPTION OF THE INVENTION

A photographic element where the blocked photographically useful compound is represented by the formula:

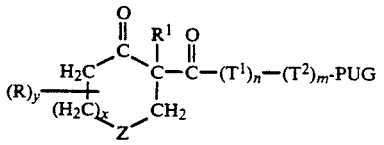

wherein $T^1$ and $T^2$ individually are releasable timing groups;

n and m individually are 0 or 1;

PUG is a photographically useful group;

x is 0, 1 or 2;

$R^1$ is unsubstituted or substituted alkyl;

Z is located at any ring position not adjacent to the ketocarbonyl group and;

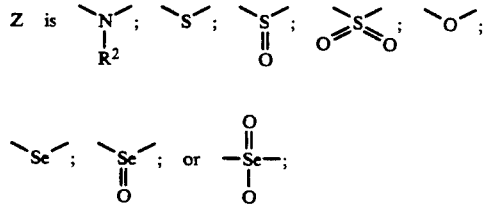

$R^2$ is H; $-C(=O)-R^3$; $-C(=O)-O-R^3$; $-SO_2-R^3$;

substituted or unsubstituted alkyl or aryl or a photographic ballast group;

$R^3$ is unsubstituted or substituted alkyl, or aryl or

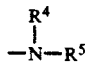

$R^4$ and $R^5$ individually are hydrogen, or unsubstituted or substituted alkyl, or aryl;

R is substituted or unsubstituted alkyl or aryl or a photographic ballast group replacing a ring hydrogen; and Y is 0, 1, 2 or 3 represents a preferred embodiment of the invention.

With the nitrogen hetero-atom, a preferred formula is:

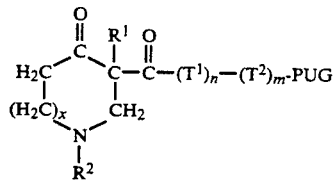

and another formula is:

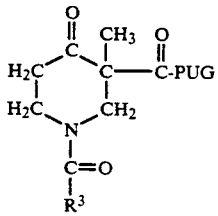

with further preferred blocked photographically useful compounds represented by the formula:

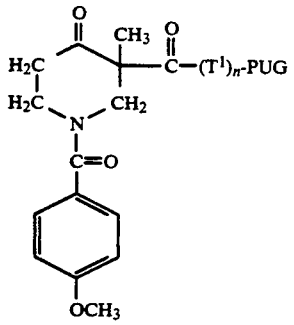
Examples of suitable blocked photographically useful compounds within the above formula are represented by the formulas:
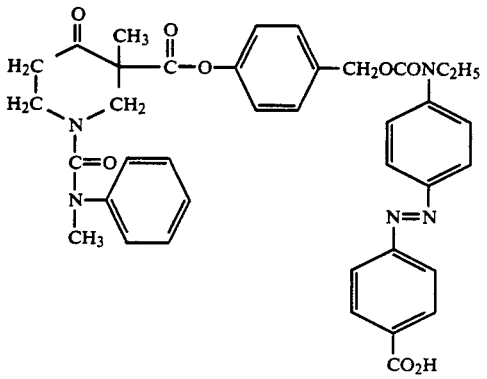
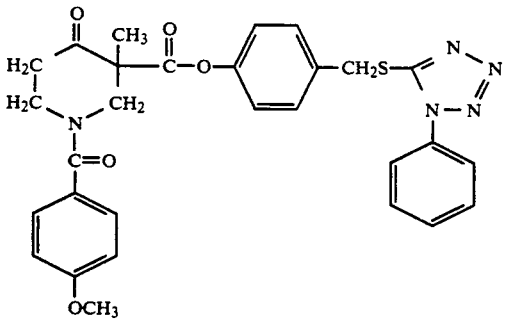
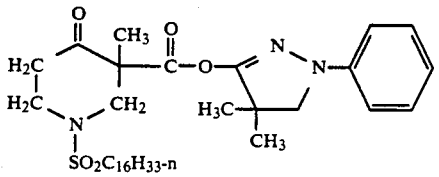
-continued
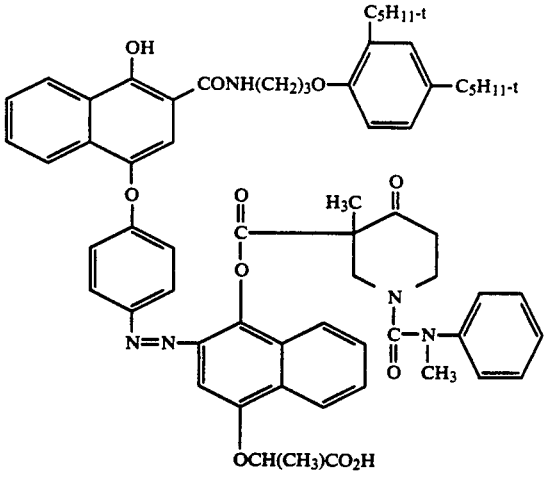
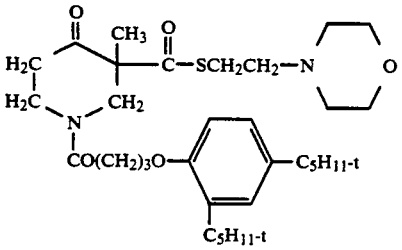
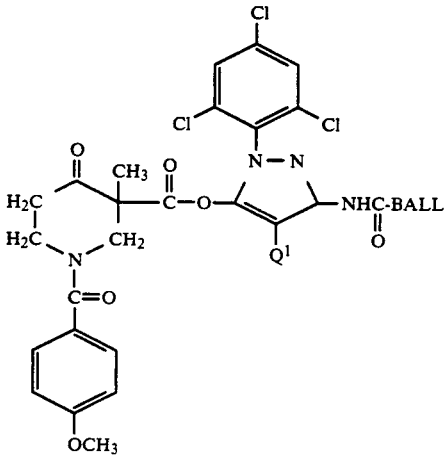
and
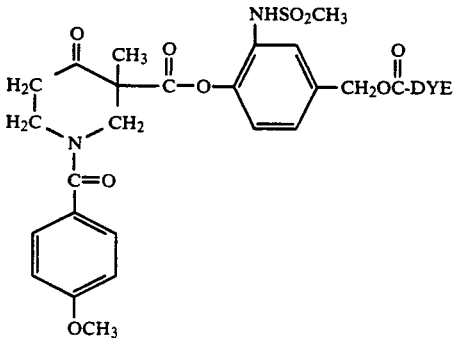
wherein
$Q^1$ is hydrogen or a coupling-off group; BALL is a ballast group; and DYE represents the atoms completing a dye.

The blocking group as described can contain a ballast group (BALL). Ballast groups known in the photographic art can be used for this purpose.

One embodiment of the invention is a photographic element comprising a blocked photographically useful compound containing the new blocking group as described. Another embodiment is a process of forming a photographic image by developing an exposed photographic element as described, preferably in the presence of a dinucleophile reagent. A further embodiment is a new photographically useful compound containing the new blocking group as described.

The blocked photographically useful compounds enable both excellent storage stability and more rapid release upon processing of a photographic element containing such a compound. Both of these properties are achieved by the blocked photographically useful compounds as described due at least in part to the particular structure of the new blocking group. The described blocked photographically useful compounds react only very slowly with nucleophilic compounds containing one nucleophilic group, such as methylamine, hydroxide or water, that help reduce storage stability of the photographic element containing such compounds. However, release occurs very rapidly upon reaction with a nucleophilic compound containing two nucleophile groups, described herein as a dinucleophile reagent, such as hydrogen peroxide and substituted and unsubstituted hydroxylamines, hydrazines and diamines. Moreover the described blocking group in the blocked photographically useful compounds enables more rapid release during photographic processing, such as more rapid release than the examples of blocked photographically useful compounds in U.S. Pat. No. 5,019,492.

In chemical systems requiring the good storage properties and the more rapid release properties of the compounds as described, the release of the blocking group can be initiated by reaction of the blocking group with an appropriate dinucleophile reagent. Depending upon the particular photographically useful group, the particular blocking group and the desired end use of the compound, the initiation of deblocking can take place by reacting the particular dinucleophile reagent at concentrations and under conditions that enable the desired rate of release.

The dinucleophile herein means a compound represented by the formula:

$$HNU_1—Nu_2H$$

wherein $Nu_1$ and $Nu_2$ individually are nucleophilic N, O, S, P, Se, substituted nitrogen atoms, or substituted carbon atoms; $X^1$ is a chain of j atoms wherein j is 0, 1 or 2. Illustrative examples of useful dinucleophile reagents are as follows:

| J = 0: | J = 1: | J = 2: |
|---|---|---|
| $H_2O_2$ | $CH_2CONH_2$ | $NH_2CH_2CH_2NH_2$ |
| $NH_2NH_2$ | $NH_2$ | $NH_2CH_2CO_2H$ |
| $CH_3NHNHCH_3$ | \| | $NH_2C(CH_3)_2CH_2OH$ |
| $NH_2OH$ | $NH_2—C=NH$ | $NH_2CH_2CH_2SH$ |
| $CH_3NHOH$ | $NH_2$ | |
| O | \| | 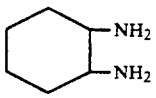 |
| ‖ | $CH_3—C=NH$ | |
| $CH_3C—NHOH$ | | |
| $CH_3SO_2NHNH_2$ | | |

Preferred dinucleophile reagents are hydroxylamine, hydrogen peroxide, and monosubstituted hydroxylamine. The dinucleophile reagent herein also includes a salt form of the reagent, such as the acid salts, for example, sulfate or bisulfite salts.

As used herein the term photographically useful group (PUG) refers to any group that can be used in a photographic material and that can be released from the blocking group as described. It refers to the part of the blocked photographically useful compound other than the blocking group and timing group(s). The PUG can be, for example, a photographic dye or photographic reagent. A photographic reagent herein is a moiety that upon release further reacts with components in the photographic element. Such useful photographically useful groups include, for example, couplers (such as, image dye-forming couplers, development inhibitor releasing couplers, competing couplers, polymeric couplers and other forms of couplers), development inhibitors, bleach accelerators, bleach inhibitors, inhibitor releasing developers, dye precursors, developing agents (such as competing developing agents, dye-forming developing agents, developing agent precursors, and silver halide developing agents), silver ion fixing agents, silver halide solvents, silver halide complexing agents, image toners, pre-processing and post-processing image stabilizers, hardeners, tanning agents, fogging agents, antifoggants, ultraviolet radiation absorbers, nucleators, chemical and spectral sensitizers or desensitizers, surfactants, and precursors thereof and other addenda known to be useful in photographic materials.

The PUG can be present in the photographically useful compound as a preformed species or as a precursor. For example, a preformed development inhibitor may be bonded to the blocking group or the development inhibitor may be attached to a timing group that is released at a particular time and location in the photographic material. The PUG may be, for example, a preformed dye or a compound that forms a dye after release from the blocking group.

The photographically useful compound can optionally contain at least one releasable timing group (T) between PUG and the blocking group as described. The reaction of the photographically useful compound with a dinucleophile reagent can sequentially release the blocking group from the timing group and then the timing group can be released from the PUG. The term "timing group" herein also includes a linking group that involves little or no observable time in the release action. This can occur in, for example, the development step of an exposed photographic element when the developer composition comprises a dinucleophile reagent, such as a hydroxylamine. Any timing group that is known in the photographic art is useful as the timing group between PUG and the blocking group. Examples of useful timing groups are described in, for example, U.S. Pat. Nos. 4,248,962 and 4,409,323 and European Patent Application 255,085.

The particular timing groups employed, including the linkage by which they are attached to the PUG and the blocking group and the nature of the substituents on the timing group can be varied to help control such parameters as rate and time of bond cleavage of the blocking group and the PUG as well as diffusibility of the PUG and substituent groups.

If the PUG is joined to the blocking group only through the timing group, then the cleavage of the bond between the timing group and the blocking group releases the timing group and the PUG as a unit. The particular timing group in this case can control the rate and distance of diffusion in the photographic material before the PUG is released from the timing group. The timing group should not contain a structure that inhibits the reaction of the blocking group with a dinucleophile reagent.

In the formulas as described timing groups $T_1$ and $T_2$ are independently selected to provide the desired rate and time of release of the PUG upon processing. The timing groups $T_1$ and $T_2$ can be the same or different. Examples of preferred timing groups of $T_1$ and $T_2$ are as follows:

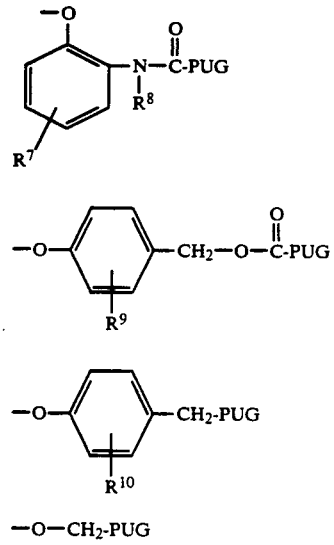

wherein PUG is as described; and, $R^7$, $R^8$, $R^9$ and $R^{10}$ and individually are hydrogen or substituents, such as alkyl, aryl, nitro, chloro and sulfonamido.

Other examples of useful timing groups are described in, for example, U.S. Pat. No. 4,248,962 and U.S. Pat. No. 4,772,537.

Illustrative examples of useful PUG's that can be blocked with the blocking groups as described are as follows:

I. Couplers

A. Image Dye-Forming Couplers: Illustrative couplers include cyan, magenta and yellow image dye-forming couplers that are known in the photographic art. Illustrative cyan dye-forming couplers that can comprise the blocking group, as described include, for example, those described in U.S. Pat. Nos. 2,772,162; 2,895,826; 3,002,836; 3,034,892; 2,474,293; 2,423,730; 2,367,531; 4,333,999; and 3,041,236. Illustrative magenta dye-forming couplers that can comprise the blocking group, as described include those described in, for example, U.S. Pat. Nos. 2,600,788; 2,369,489; 2,343,703; 2,311,082; 3,152,896; 3,152,896; 3,519,429; 3,062,653; and 2,908,573. Illustrative yellow dye-forming couplers that can contain the blocking group, as described include those described in, for example, U.S. Pat. Nos. 2,875,057; 2,407,210; 3,265,506; 2,298,443; 3,048,194; and 3,447,928.

B. Illustrative couplers that form colorless products upon reaction with oxidized color developing agents and contain the blocking group, as described include those described in, for example, U.S. Pat. Nos. 3,632,345; 3,928,041; 3,958,993; 3,961,959; and U.K. Patent No. 861,138.

C. Illustrative couplers that form black dyes upon reaction with oxidized color developing agents and that can contain the blocking group, as described, include those described in, for example, U.S. Pat. Nos. 1,939,231; 2,181,944; 2,333,106; and 4,126,461; German OLS No. 2,644,194 and German OLS No. 2,650,764.

D. Illustrative couplers that are development inhibitor releasing couplers (DIR couplers) and can contain the blocking group, as described, include those described in, for example, U.S. Pat. Nos. 4,248,962; 3,227,554; 3,384,657; 3,615,506; 3,617,291; 3,733,201; and U.K. 1,450,479. Preferred development inhibitors as PUG's are heterocyclic compounds, such as mercaptotetrazoles, mercapto- triazoles, mercaptooxadiazoles, selenotetrazoles, mercaptobenzothiazoles, selenobenzothiazoles, mercaptobenzoxazoles, selenobenzoxazoles, mercaptobenzimidazoles, selenobenzimidazoles, benzotriazoles, benzodiazoles and 1,2,4-triazoles, mercaptothiadiazoles, tetrazoles, and imidazoles.

E. PUG's that are, or form, dyes upon release:

Useful dyes and dye precursors include azo, azomethine, azopyrazolone, indoaniline, indophenol, anthraquinone, triarylmethane, alizarin, nitro, quinoline, indigoid, oxanol, and phthalocyanine dyes and precursors of such dyes, such as leuco dyes, tetrazolium salts or shifted dyes. These dyes can be metal complexed or metal complexable. Representative patents describing such dyes are U.S. Pat. Nos. 3,880,568; 3,931,144; 3,932,380; 3,932,381; and 3,942,987. Structures of illustrative dyes that can be blocked as described are as follows:

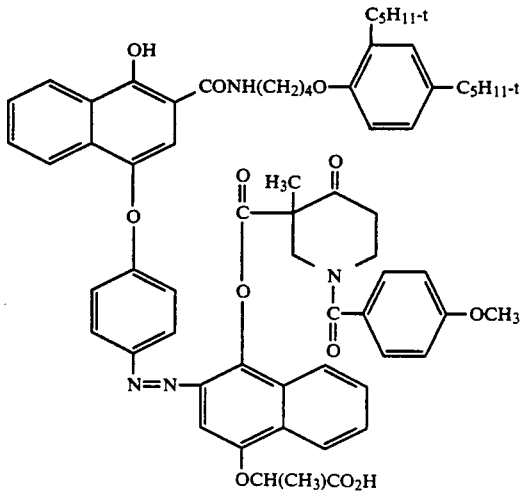

-continued

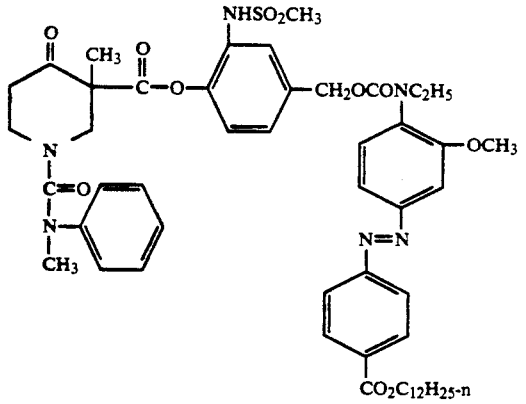

F. PUG's that form developing agents:

Developing agents released can be color developing agents, black-and-white developing agents and cross-oxidizing developing agents. They include aminophenols, phenylenediamines, hydroquinones and pyrazolidones. Representative patents describing such developing agents are U.S. Pat. Nos. 2,193,015; 2,108,243; 2,592,364; 3,656,950; 3,658,525; 2,751,297; 2,289,367; 2,772,282; 2,743,279; 2,753,256; and 2,304,953.

Structures of preferred developing agents are:

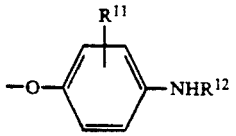

IIID-1 where $R^{12}$ is hydrogen or alkyl of 1 to 4 carbon atoms and $R^{11}$ is hydrogen or one or more halogen (e.g. chloro, bromo) or alkyl of 1 to 4 carbon atoms (e.g. methyl, ethyl, butyl) groups and alkoxy.

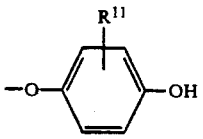

IIID-2 where $R^{11}$ is as defined above.

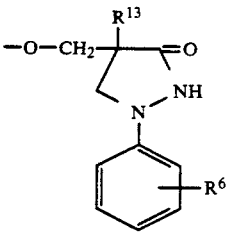

IIID-3

-continued

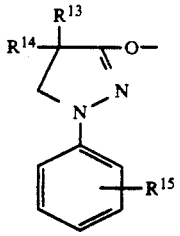

IIID-4

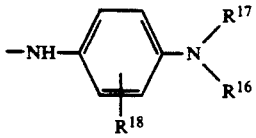

IIID-5

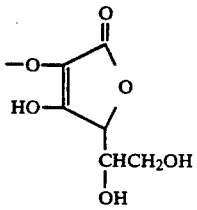

III-6 where $R^{15}$ is hydrogen or one or more alkyl, alkoxy or alkenedioxy groups of 1 to 4 carbon atoms and $R^{13}$, $R^{14}$, $R^{16}$, $r^{17}$ and $R^{18}$ individually are hydrogen, alkyl of 1 to 4 carbon atoms (e.g. methyl, ethyl) lower hydroxyalkyl of 1 to 4 carbon atoms (e.g. hydroxymethyl, hydroxymethyl) or lower sulfoalkyl.

G. PUG's that are bleach inhibitors:

Representative bleach inhibitors that can be blocked as described include the illustrative bleach inhibitors described in, for example, U.S. Pat. Nos. 3,705,801; 3,715,208 and German OLS No. 2,405,279. Structures of illustrative bleach inhibitors are:

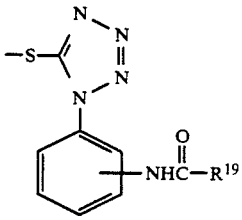

IIIE-1

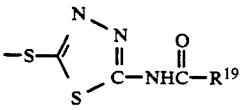

IIIE-2

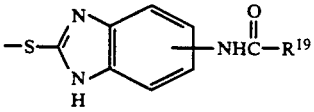

IIIE-3

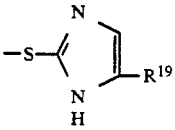

IIIE-4 where $R^{19}$ is an alkyl group of 6 to 20 carbon atoms.

H. PUG's that are bleach accelerators:

Representative bleach accelerators that can be blocked as described include the illustrative bleach accelerators represented by the following structures:

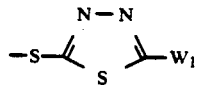
IIIF-1

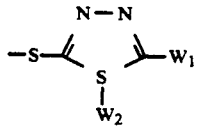
IIIF-2

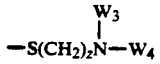
IIIF-3

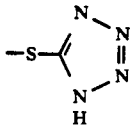
IIIF-4

$SCH_2CH_2CO_2H$ IIIF-5 wherein $W_1$ is hydrogen, alkyl, such as ethyl and butyl, alkoxy, such as ethoxy and butoxy, or alkylthio, such as ethylthio and butylthio, for example containing 1 to 6 carbon atoms, and which may be unsubstituted or substituted; $W_2$ is hydrogen, alkyl or aryl, such as phenyl; $W_3$ and $W_4$ are individually alkyl, such as alkyl containing 1 to 6 carbon atoms, for example ethyl and butyl or together can form a ring, such as morpholino; z is 1 to 6.

Other PUG's as described in the photographic art can also be blocked with a blocking group as described.

The blocked photographically useful compounds as described can be used in photographic materials and in ways that blocked photographic compounds have been used in the photographic art.

For example, the blocked photographic couplers can be incorporated in photographic elements and/or photographic processing compositions, such that upon development in the presence of a dinucleophile reagent the exposed photographic element and coupler will be in reactive association with oxidized color developing agent. When incorporated in a photographic element, the coupler compounds should as a rule be non-diffusible, that is they should be of such molecular size and configuration that they will not significantly diffuse or wander from the layer in which they are coated.

Photographic elements of the invention can be processed by conventional techniques in which color forming couplers and color developing agents are incorporated in separate processing solutions or compositions or in the photographic element. Option- ally, blocked color developing agents can be incor- porated in the photographic element and simplified processing solutions used for processing the element.

The photographic elements can be single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the photographic art. In an alternative format, the emulsions sensitive to each of the three primary regions of the spectrum can be disposed as a single segmented layer, such as by the use of microvessels as described in U.S. Pat. No. 4,362,806.

A typical multicolor photographic element comprises a support bearing a cyan dye imageforming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one yellow dye-forming coupler. The element can contain added layers, such as filter layers, interlayers, overcoat layers, subbing layers, and the like.

The blocked photographically useful compounds as described can be present in and/or associated with one or more of the layers of the photographic element. The compounds can be in an emulsion layer and/or in an adjacent layer.

In the following discussion of materials useful in the emulsions and elements of the invention, reference will be made to *Research Disclosure,* Dec. 1978, Item No. 17643, and *Research Disclosure,* Dec. 1989, Item No. 308119, published by Industrial Opportunities Ltd., Homewell Havant, Hampshire, PO9 1EF, U.K., the disclosures of which are incorporated herein by reference. These publications will be identified hereinafter by the term "Research Disclosure".

The silver halide emulsions employed in the elements can be comprised of silver bromide, silver chloride, silver iodide, silver chlorobromide, silver chloroiodide, silver bromoiodide, silver chlorobromoiodide or mixtures thereof. The emulsions can include coarse, medium or fine silver halide grains. High aspect ratio tabular grain emulsions are specifically contemplated, such as those described by Wilgus U.S Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB 1,027,146; JA 54/48,521; U.S. Pat. No. 4,379,837; U.S. Pat. No. 4,444,877; U.S. Pat. No. 4,665,012; U.S. Pat. No. 4,686,178; U.S. Pat. No. 4,565,778; U.S. Pat. No. 4,728,602; U.S. Pat. No. 4,668,614; U.S. Pat. No. 4,636,461; EP 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negativeworking emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in Research Disclosure, Item 17643, cited above, Section III and Research Disclosure, Item 308119, cited above.

The silver halide emulsions can be spectrally sensitized with dyes from a variety of classes, including the polymethine dye class, which includes the cyanines, merocyanines, complex cyanines and merocyanines (i.e., tri-, tetra-, and poly- nuclear cyanines and merocyanines), oxonols, hemioxonols, styryls, merostyryls, and streptocyanines. Illustrative spectral sensitizing dyes are disclosed in Research Disclosure, Item 17643, cited above, Section IV and in Research Disclosure Item No. 308119, cited above.

Suitable vehicles for the emulsion layers and other layers of elements of this invention are described in Research Disclosure Item 17643, Section IX, and Research Disclosure, Item No. 308119, and the publications cited therein.

In addition to the couplers described herein the elements of this invention can include additional couplers as described in Research Disclosure, Item No. 17643 Section VII, paragraphs D, E, F and G and Research Disclosure Item No. 308119, and the publications cited therein. These additional couplers can be incorporated as described in Research Disclosure, Item No. 17643, Section VII, paragraph C and Research Disclosure, Item No. 308119, and the publications cited therein.

The photographic elements as described can contain brighteners (Research Disclosure Item No. 308119, Section V), antifoggants and stabilizers (Research Disclosure Item No. 308119, Section VI), antistain agents and image dye stabilizers (Research Disclosure Item No. 308119, Section VII, paragraphs I and J), light absorbing and scattering materials (Research Disclosure Item No. 308119, Section VIII), hardeners (Research Disclosure Item No. 308119, Section X), coating aids (Research Disclosure Item No. 308119, Section XI), plasticizers and lubricants (Research Disclosure Item No. 308119, Section XII), antistatic agents (Research Disclosure Item No. 308119, Section XIII), matting agents (Research Disclosure Item No. 308119, Section XVI) and development modifiers (Research Disclosure Item No. 308119, Section XXI).

The photographic elements can be coated on a variety of supports as described in Research Disclosure Item No. 308119, Section XVII and the references described therein.

Photographic elements can be exposed to actinic radiation, typically in the visible region of the spectrum, to form a latent image as described in Research Disclosure Item No. 308119, Section XVIII and then processed to form a visible dye image as described in Research Disclosure Item No. 308119, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4- amino-3-methyl-N, N-diethylaniline hydrochloride, 4-amino-3-methyl-N-ethyl-N-ö-(methanesulfonamido)ethylaniline sulfate hydrate, 4-amino-3-methyl-N-ethyl-N-ö-hydroxyethylaniline sulfate, 4-amino-3-ö-(methanesulfonamido)ethyl-N,N-diethylaniline hydrochloride and 4-amino-N-ethyl-N-(2-methoxy-ethyl)-m-toluidine di-p-toluene sulfonic acid.

With negative-working silver halide, the processing step described above provides a negative image. The described elements are preferably processed in the known C-41 color process as described in, for example, the British Journal of Photography Annual of 1988, pages 196 -198. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleachfixing, to remove silver or silver halide, washing, and drying.

In processing it is preferable that the described dinucleophile reagent, such as a hydroxylamine, be present in the processing solution that is to be used to release or unblock the blocked photographically useful compound at the time desired. The concentration of the dinucleophile reagent in the processing solution can vary depending on such factors as the particular processing solution components, the particular dinucleophile reagent, the processing time and temperature, the particular photographic element to be processed, the desired image and the like. When the dinucleophile reagent is present in a color developer solution, the concentration of the dinucleophile reagent is typically within the range of $10^{-5}$ moles to 1 mole per liter of solution.

The blocked photographically useful compounds as described can be prepared by methods and steps known in the organic compound synthesis art.

A typical method of preparing a blocked photographically useful compound is as follows:

Synthesis I

Preparation of:

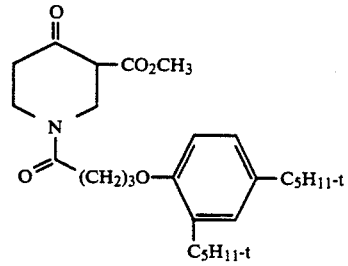

To a mechanically-stirred solution of 20g of methyl 4-oxo-3-piperidine carboxylate hydrochloride dissolved in 100 ml of water was added 12 g of potassium bicarbonate. After complete dissolution of the solid, a solution of 35g of 4-(2,4-di-t-amylphenoxy) butyryl chloride dissolved in 100 ml of ligroin (bp 35-50) was added.

While stirring vigorously, an additional 10g of solid potassium bicarbonate was added. After stirring for one hour, the layers were separated. The organic layer was sequentially treated with 5% aqueous hydrochloric acid, water, and saturated aqueous sodium chloride solution. After drying over solid anhydrous sodium sulfate, the solvent was evaporated from the organic layer to give 49g of product as a light gold oil. The $^1H$ NMR spectrum was consistent with the desired structure. Preparationof:

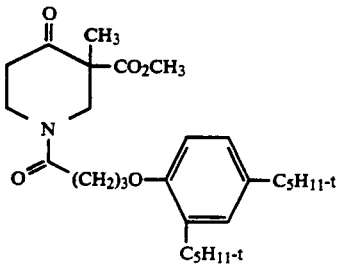

A well stirred mixture of 49 g of the above material, 40 g of cesium carbonate, 50 mL of iodomethane, and 250 mL of acetone was held at reflux for one hour. After cooling to room temperature, the reaction mixture was filtered to remove solid. The resulting oil was re-dissolved in diethyl ether and dried over solid anhydrous sodium sulfate. Filtration and evaporation of solvent gave 49 g of gold oil. $^1H$ NMR was consistent with the desired structure. Mass spectral analysis was also consistent. By silica gel thin layer chromatography, the product had Rf=0.71 using 50/50 diethyl ether/ligroin(bp 35–50) as eluent.

Preparation of:

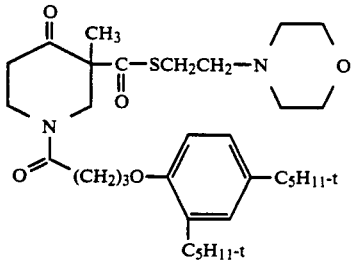

To a stirred solution of 18 g of the above alkylated methyl ester in 150 mL of methylene chloride under nitrogen was added cautiously 4 mL of boron tribromide. After stirring for 15 minutes, 50 mL of water was added slowly. The reaction was stirred for 5 minutes, and then the layers were separated. The organic layer was dried over anhydrous sodium sulfate. After removing the solid by filtration, the filtrate was treated with 10 mL of oxalyl chloride overnight. The next day, the solvent was removed by evaporation. The residual oil and 5.5 grams of 2-morpholinoethanethiol were dissolved in 200 mL of methylene chloride. To this stirred solution was added 5.5 mL of triethylamine. After stirring for 3 days, the volatiles were removed by evaporation. The residue was stirred with diethyl ether and then filtered to remove undissolved solid. The evaporated residue was chromatographed on silica gel using 20/80 diethyl ether/methylene chloride to isolate the product having Rf=0.33 (same solvent system). 'H and $^{13}C$ NMR spectra were consistent with the proposed structure. Mass spectral analysis was also consistent. By this method, 2 g of thiol ester was made.

Synthesis II

Preparation of blocked compounds with sulfur heteroatom:

A solution of 100 g of 3,3'-thiodiproionic acid, 120 ml of allyl alcohol, 0.5 g of paratoluenesulfonic acid monohydrate, and 100 ml of toluene was heated at reflux for 10 hr. with azeotropic removal of water. After cooling to room temperature, the organic phase was washed with saturated aqueous sodium bicarbonate solution, and the layers separated. The organic layer was dried over anhydrous sodium sulfate, filtered, and evaporated to give 146 g of the desired diallyl ester of structure S-1 as a gold oil. 1H NMR (CDC13) 6.1–5.6 (m,2H), 5.4–5.0 ( three broad peaks, 4H), 4.5 (d,4H), and 2.9–2.4 (m,8H). A trace of toluene was also present. This material was suitable as is for future use.

COMPOUND S-1

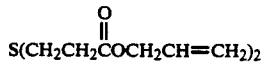

To a stirred suspension of 45 g of an 80% dispersion of sodium hydride in oil under nitrogen in 600 ml of dry tetrahydrofuran was added linearly over a period of 4 hr., 120 g of allyl alcohol. After stirring for 1 hr, 240 g of the previously prepared diallyl ester was added linearly over a period of 4 hr. The reaction was then taken to reflux and held for 4 hr. After cooling to room temperature, 120 g of acetic acid was linearly added over a period of 4 hr. The precipitated solid is removed via Celite-aided filtration. The evaporated residue is passed through silica gel using 5% ether/ 95% ligroin (bp 30–60) as eluent to give 115 g of the desired beta-ketoester of structure S-2 as a clear oil. (Rf=0.44 on silica gel using 10% ether/ 90% ligroin (bp 30–60)) 1H NMR (CDC13) 12.3 (s, 2/3 H), 5.9–5.5 (m,1H), 5.3–5.0 (m,2H), 4.6 (d,2H), 3.2 (s,2H), 2.6 (t,2H), and 2.5 (t, 2H).

COMPOUND S-2

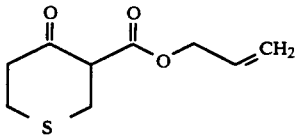

While stirring a suspension of 60 g of potassium t-butoxide in 1000 ml of dry tetrahydrofuran under nitrogen, 100 g of the unalkylated beta-ketoester was added linearly over a period of 50 minutes. The reaction was then heated to reflux. While at reflux, 70 g of iodomethane was added linearly over a period of 35 minutes. After a period of 10 minutes at reflux, 20 g of additional iodomethane was added linearly over a period of 10 minutes while the reaction was still at reflux. The 10 minute reflux period followed by the 10 minute addition period of iodomethane was repeated 2 additional times. The reaction was then held at reflux for 2hr. and cooled to room temperature. After Celite-aided filtration, the evaporated residue was passed through 1.5 kg of silica gel using 5% ether / 95% ligroin (bp 30–60) as eluent to give 45 g of methylated beta-ketoester of structure S-3 as a clear oil. (Rf=0.29 on silica gel using 10% ether / 90% ligroin (bp 30–60)). 1H NMR (CDC13): 6.0–5.8

(m,1H), 5.3–5.2 (m, 2H), 4.6 (d,2H), 3.3 (doublet of doublets, 1H), 3.0–2.6 (m,5H), and 1.4 (s,3H).

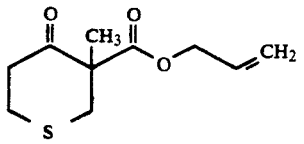

COMPOUND S-3

To a stirred suspension of 16 g of methylated beta-ketoester and 15 g of tetramethylammonium acetate in 250 mL of dichloromethane and 50 mL of tetrahydrofuran was added 0.5 g of tetrakis(triphenylphosphine) palladium. The reaction was stirred under nitrogen in the absence of light for 0.5 hr. To the thick suspension was cautiously added 10 ml of oxalyl chloride in very small portions. Foaming was allowed to subside between additions. After stirring for 0.5 hr, the volitiles were removed by rotary evaporation. An additional 100 ml of fresh dichloromethane was added, and the volatiles were again removed. The residue was assumed to contain the desired acid chloride of structure S-4 and was used as is to make derivatives. The acid chloride was then reacted with the corresponding chloride of the desired photographic group to yield the finished blocked group in the same manner as in synthesis I.

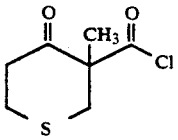

COMPOUND S-4

In chemical systems that require a blocked reagent, the reagent can be released by reaction with a dinucleophile reagent. The reagent can be released by any dinucleophile reagent that is compatible with the particular chemical system. Selection of an optimum dinucleophile reagent and a particular blocked reagent will depend upon the particular chemical system, the desired end use of the blocked reagent, the particular conditions used for release. The blocking group can be as described in such blocked reagents.

The following examples further illustrate the invention.:

EXAMPLE 1

Model studies were conducted on esters E-1 through E-6 to determine the possible rate enhancement which could be attained by using a dinucleophile rather than a mononucleophile to promote the removal from a phenolic moiety of a blocking group of this invention. Aqueous solutions A, B, and C, each containing 50% by volume of acetonitrile were prepared as follows (a separate solution A for each ester):

| | |
|---|---|
| Solution A: | $2.5 \times 10^{-4}$M ester (or $2.5 \times 10^{-5}$M E-1); 0.2N KCl |
| Solution B: | 25% by volume carbonate buffer (pH 10.0, ionic strength 0.75); 0.05N KCl |
| Solution C: | Solution B with added 0.05M hydroxylamine |

Then equal volumes of A and B (or A and C) were mixed at 25° C. to give a pH 10.0 solution and the reaction was followed by spectrophotometric measurements of the phenol (290 nm) or p-nitrophenol (402 nm) produced with time. In each case a reaction half-life ($t_{\frac{1}{2}}$) was calculated from the equation $t/_{\frac{1}{2}} = \ln(2)/k$, where ln(2) is the natural logarithm of 2 and k is the pseudo first-order rate constant calculated for the reaction. Smaller half-lives thus indicate more rapid reactions. The A+B combination provides an alkaline solution in which the main reactant is hydroxide ion (a mononucleophile) while in the A.C combination the active reactant is hydroxylamine (a dinucleophile). A ratio of the A+B half-life to the A+C half-life provides a measure of rate enhancement due to participation of hydroxylamine in the deblocking reaction. The results are shown in Table I:

TABLE I

E-1, INVENTION:

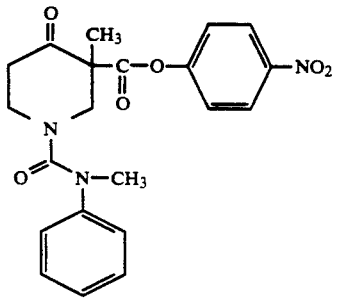

E-2, INVENTION:

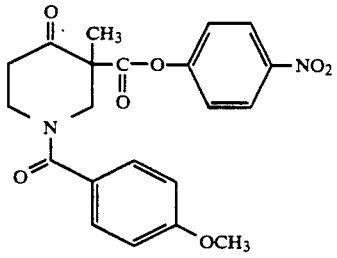

E-3, INVENTION:

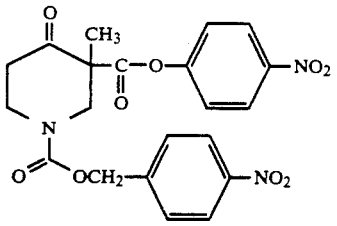

E-4, COMPARISON:

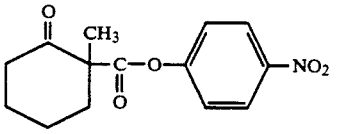

E-5, COMPARISON:

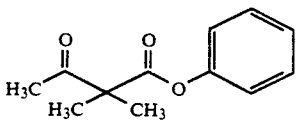

TABLE I-continued

E-6, COMPARISON:

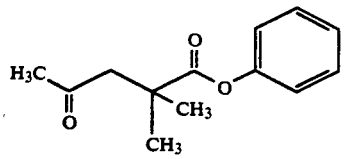

| Compound | $t_{1/2}^{A+B}$ | $t_{1/2}^{A+C}$ | Ratio |
|---|---|---|---|
| E-1 (Invention) | $5.8 \times 10^3$ | 0.15 | $3.8 \times 10^4$ |
| E-2 (Invention) | $2.0 \times 10^3$ | 0.07 | $2.9 \times 10^4$ |
| E-3 (Invention) | $3.6 \times 10^3$ | 0.10 | $3.6 \times 10^4$ |
| E-4 (Comparison) | $2.5 \times 10^5$ | 1.10 | $2.3 \times 10^5$ |
| E-5 (Comparison) | $6.3 \times 10^4$ | 1.70 | $3.7 \times 10^4$ |
| E-6 (Comparison) | $1.3 \times 10^5$ | 790 | $1.7 \times 10^2$ |

Me herein means methyl.

It can be seen from Table I that esters E-1 and E-2 are much more reactive with the dinucleophile hydroxylamine than are the comparisons. At the same time, the ratio of the two half-lives indicates that the compounds of the invention maintain excellent discrimination between reactions with a mononucleophile (hydroxide) and a dinucleophile (hydroxylamine).

EXAMPLE 2

This example demonstrates that the use of a blocking group of the invention enables both hue shifting and quantitative release during processing of a masking coupler within a photographic element. A red sensitized silver bromoiodide gelatin emulsion (0.75 micron diameter, 0.13 micron thick) was mixed with a coupler dispersion comprising cyan coupler C-1 dispersed in half its weight of di-n-butyl phthalate and a masking coupler dispersed in twice its weight of either di-n-butyl phthalate (CS-1) or 2,4-di-tertamylphenol (CS-2). Note that the masking couplers MC-1 and MC-2 are blocked versions of the masking coupler MC-3. The resulting mixture was coated on a photographic film support according to the following format (amounts of each component are given in mg/m$^2$ with silver halide counted as silver).

| | |
|---|---|
| Overcoat Layer | gelatin (2691); bis(vinylsulfonylmethyl) ether hardener (1.75% of total gelatin weight) |
| Emulsion Layer: | gelatin (3767); red-sensitized AgBrI emulsion (1076); cyan coupler C-1 (774); and a blocked masking coupler (215 mmol/m$^2$) |
| Film Support: | gelatin (4887) on 132 micron cellulose acetate with remjet backing |

Each photographic element was imagewise exposed to light through a graduated density test object in a commercial sensitometer to provide a developable latent image (5500° K light source, 0–4 step wedge, with Wratten 99 plus 0.1 ND filter. Wratten is a trademark of Eastman Kodak Co., U.S.A.). The resulting photographic film was then developed and processed in a commercial C-41 process of the Eastman Kodak Co. U.S.A. without the final stabilizer step. This process and the processing compositions for the process are described in, for example, *British Journal of Photography Annual*, 1988, pages 191–199. The development process was carried out with and without hydroxylamine sulfate (HAS) in the color developer solution. Densitometric measurements made with green light are shown in Table II.

Cyan Coupler C-1

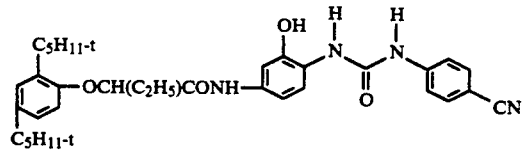

Masking Couplers

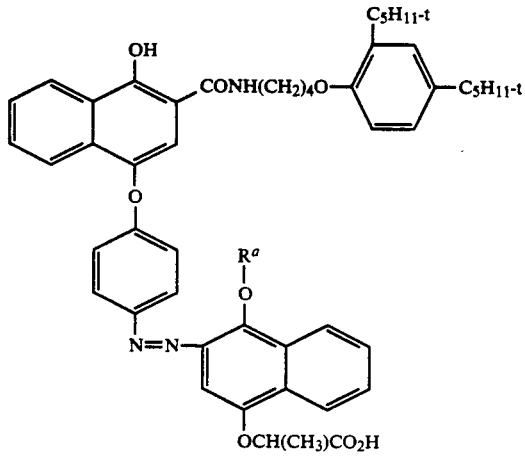

MC-1 (Invention), $R^a$=:

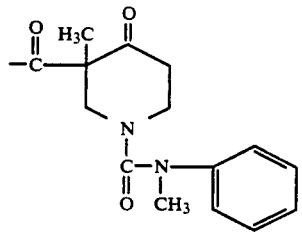

MC-2 (Comparison), $R^a$=:

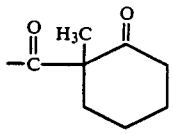

MC-3 (Comparison), $R^a$ = H

"Dg at $E_{min}$" is the green density at minimum exposure. This indicates the ability of the blocking group to shift the visible absorption of the masking dye and the extent to which the blocking group has been removed from (and masking chromophore regenerated in) the blocked masking couplers MC-1 and MC-2. Higher values correspond to greater extents of deblocking. Hence, higher values are desirable for the hydroxylaminecontaining process, lower values are desirable for the process without hydroxylamine. "WDg" is the difference between (Dg at $E_{min}$) values for the two developers. HAS herein is hydroxylamine sulfate.

TABLE II

| | (Invention) MC-1 | | (Comparison) MC-2 | | (Comparison) MC-3 | |
|---|---|---|---|---|---|---|
| | CS-1 | CS-2 | CS-1 | CS-2 | CS-1 | CS-2 |
| $D_g$ at $E_{min}$ (with HAS) | 0.32 | 0.35 | 0.20 | 0.19 | 0.35 | 0.31 |
| $D_g$ at $E_{min}$ (w/o HAS) | 0.09 | 0.09 | 0.09 | 0.09 | 0.33 | 0.30 |
| $WD_g$ | 0.23 | 0.26 | 0.11 | 0.10 | 0.02 | 0.01 |

These data demonstrate that both MC-1 and MC-2 are successful at shifting the hue of the masking coupler so as to minimize green absorption prior to deblocking. However, MC-1 was quantitatively deblocked during the hydroxylamine process, but MC-2 was only partially deblocked. Thus, only the compound of the invention, MC-1, exhibited excellent hue shifting prior to deblocking and quantitative deblocking on processing.

EXAMPLES 3-64

The following blocked photographically useful compounds can be prepared by the methods described. These blocked compounds can be incorporated and processed in a photographic element as described, such as in the element and process of Example 1: (The example number is given for each compound.)

IMAGE COUPLERS:

3.

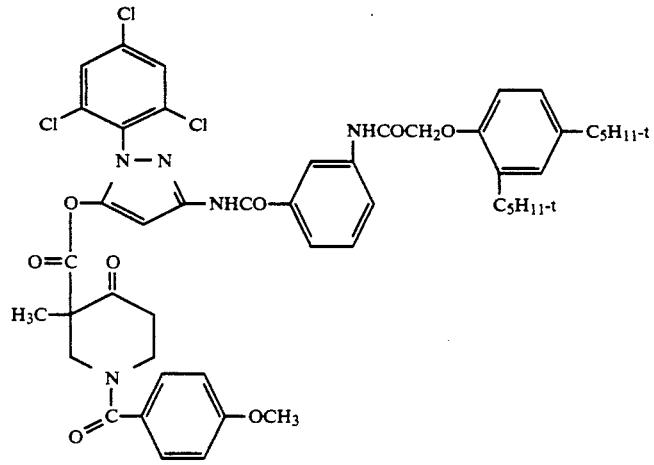

4.

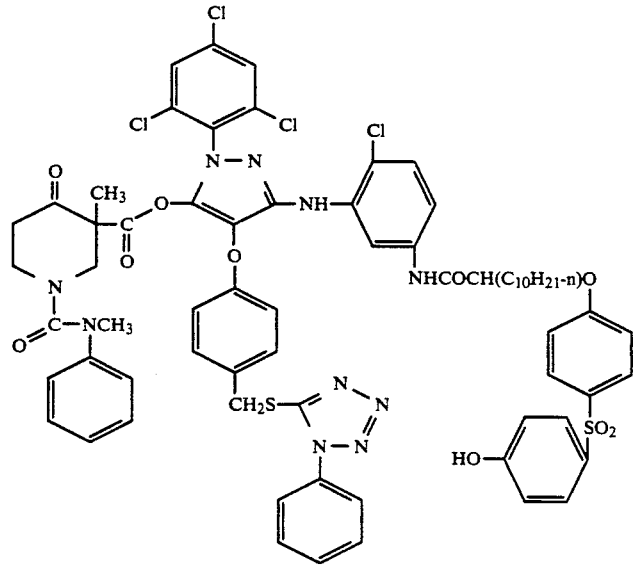

-continued
IMAGE COUPLERS:
5.
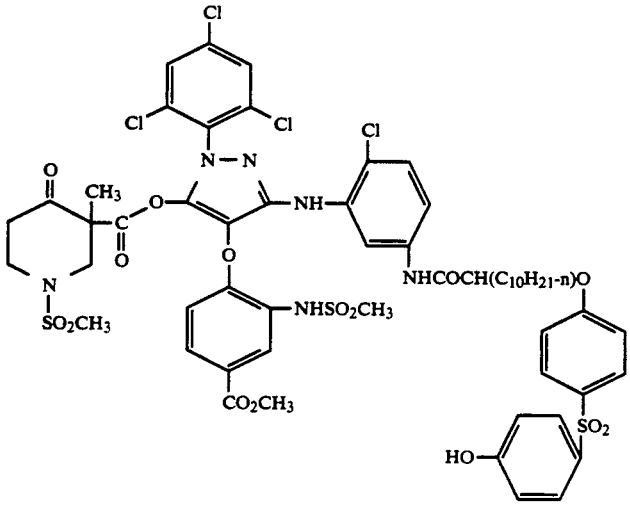
MASKING COUPLERS:
6.
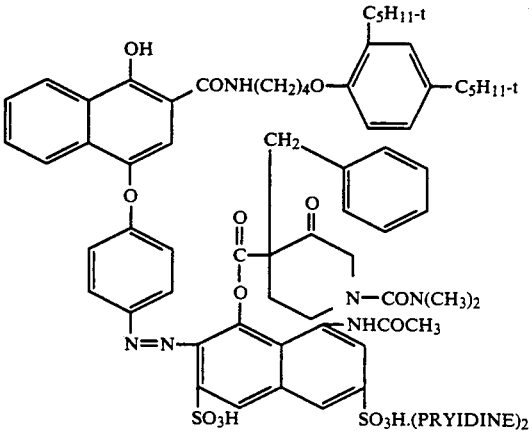
7.
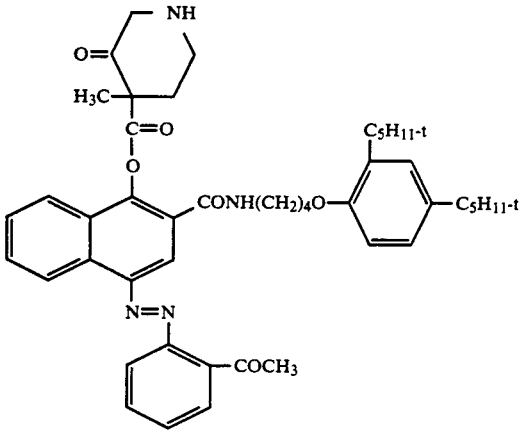

-continued
MASKING COUPLERS:
8.
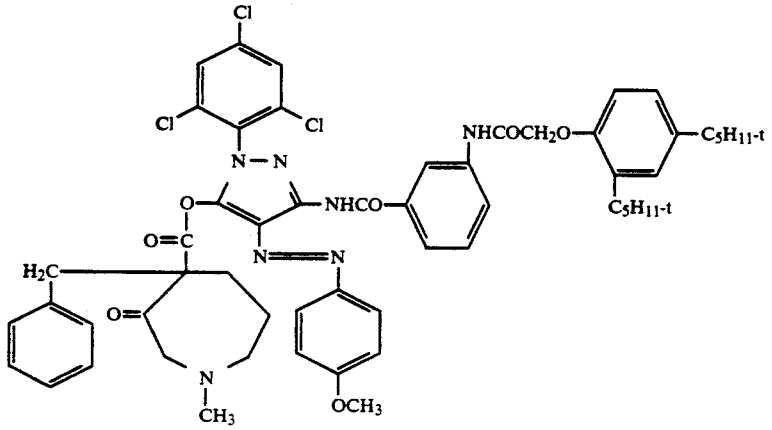
9.
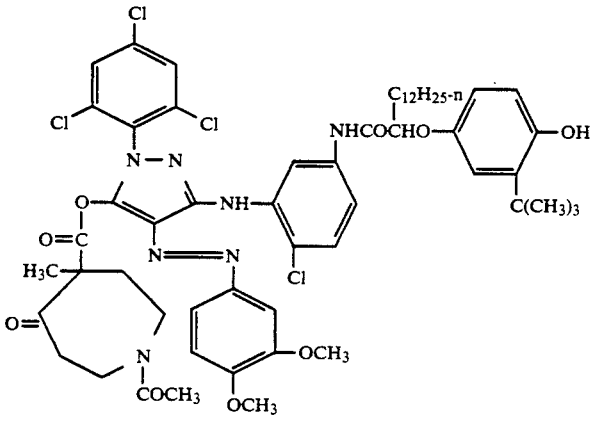
10.
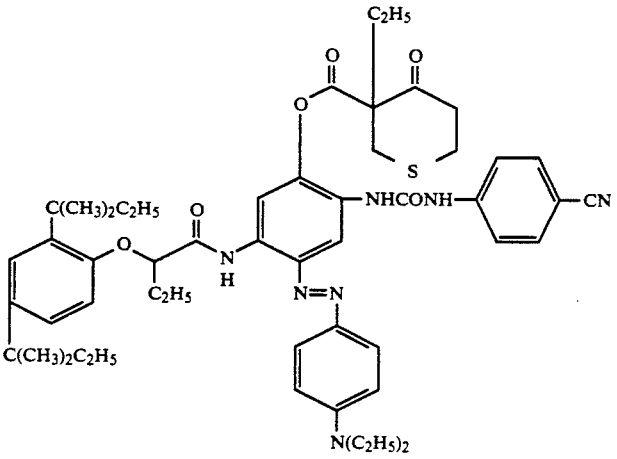

-continued
MASKING COUPLERS:
11.
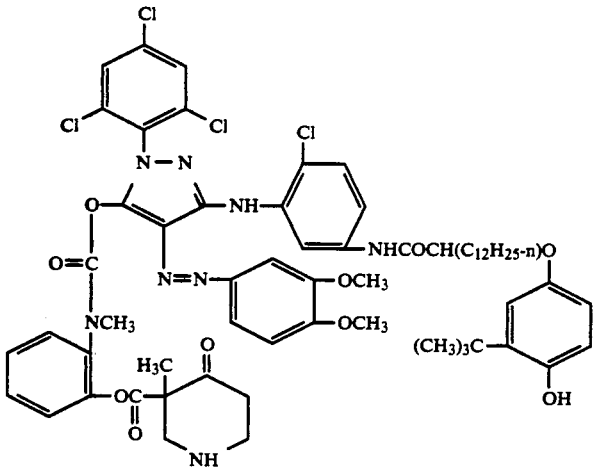
Development Accelerators and Electron Transfer Agents
12.
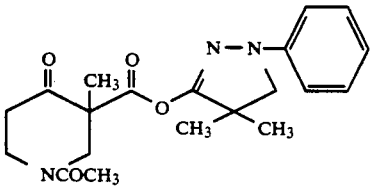
13.
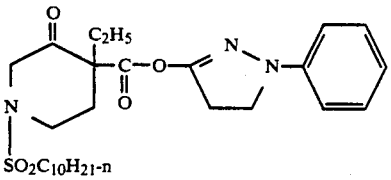
14.
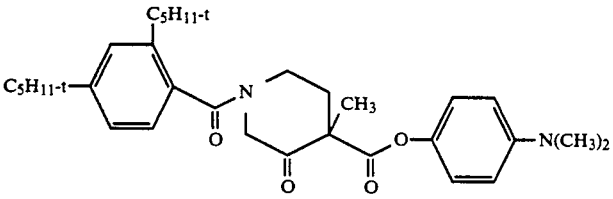
15.
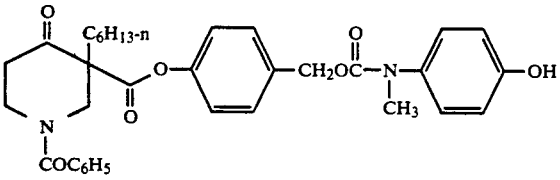
16.
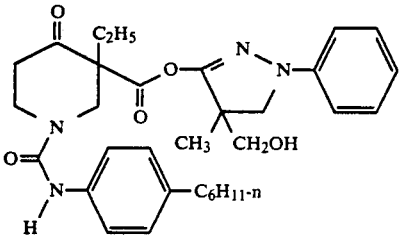

-continued
Development Accelerators and Electron Transfer Agents
17.
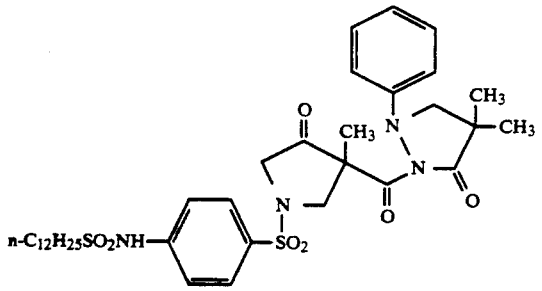
18.
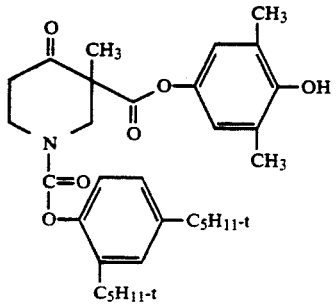
19.
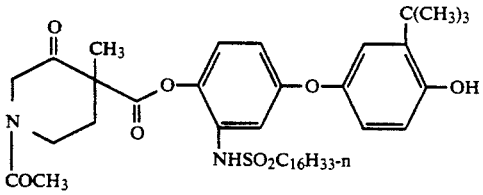
20.
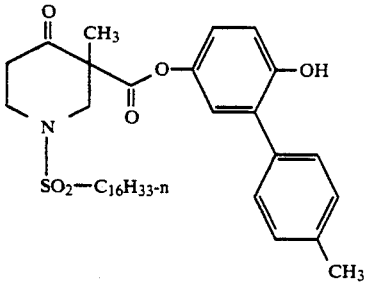
Dox Scavenger:
21.
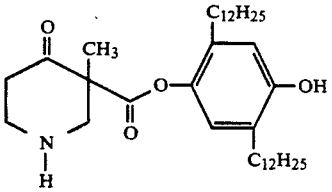
Color Developer:
22.
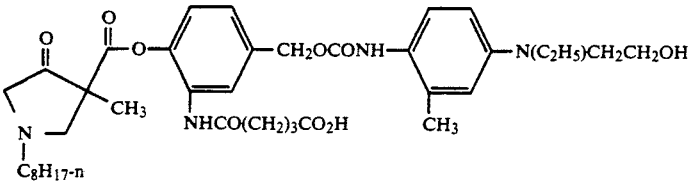

-continued
Development Accelerators and Electron Transfer Agents
23.
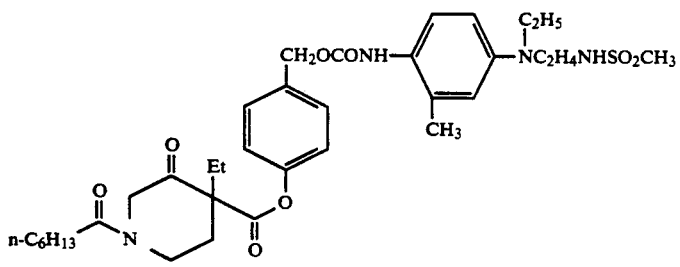
24.
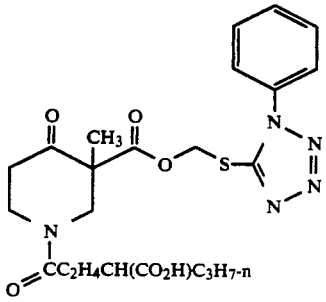
25.
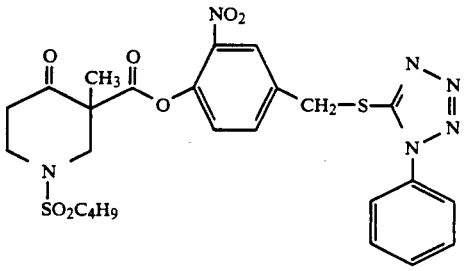
Compounds having the foregoing or other functions:
COMPOUND 26.
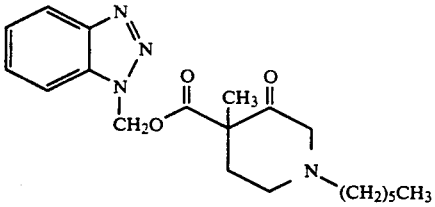
COMPOUND 27.
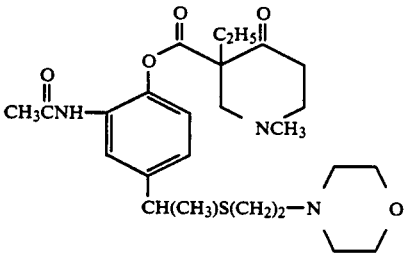

-continued
Compounds having the foregoing or other functions:
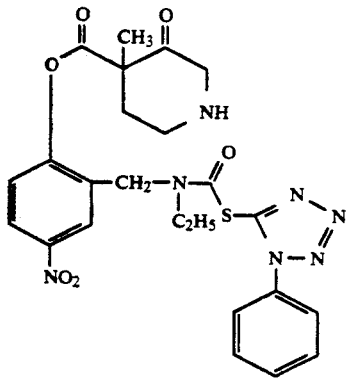
COMPOUND 28.
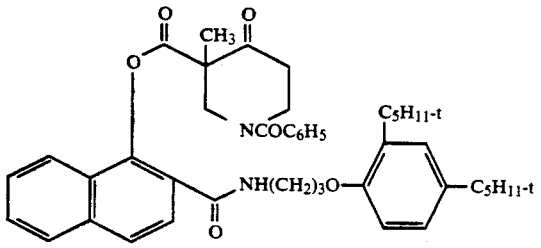
COMPOUND 29.
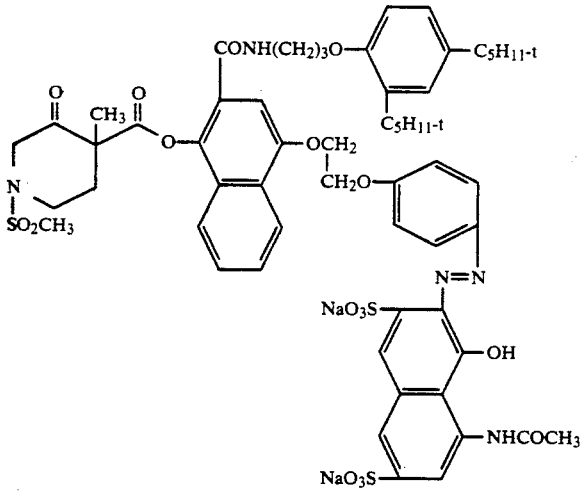
COMPOUND 30.
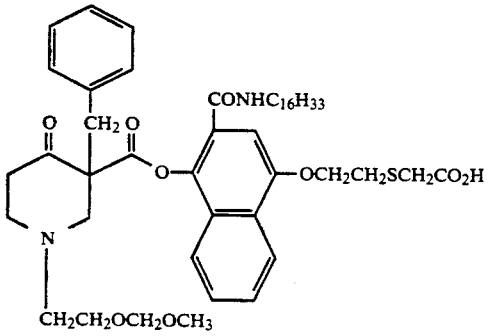
COMPOUND 31.

-continued
Compounds having the foregoing or other functions:
COMPOUND 32.
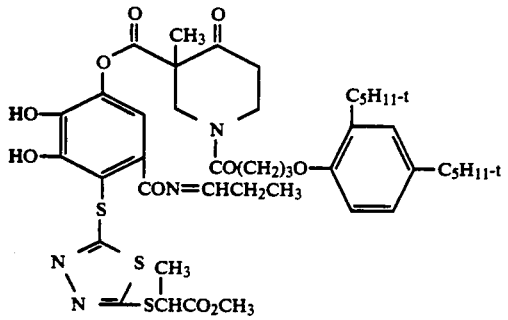
COMPOUND 33.
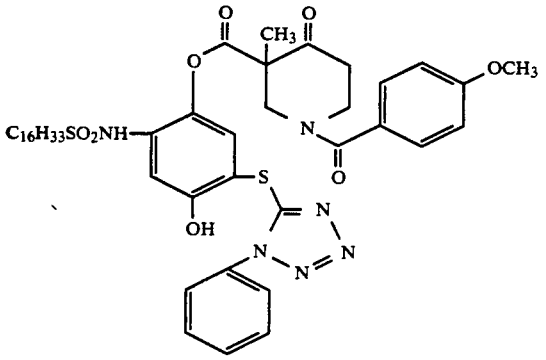
COMPOUND 34.
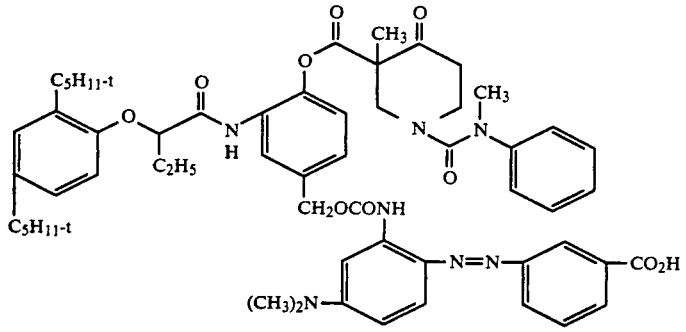
COMPOUND 35.
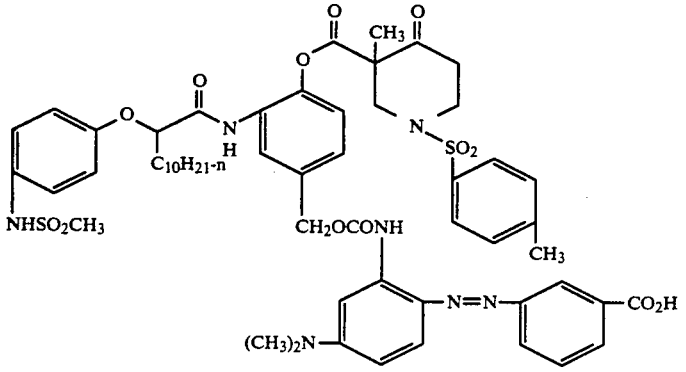

-continued
Compounds having the foregoing or other functions:
COMPOUND 36.
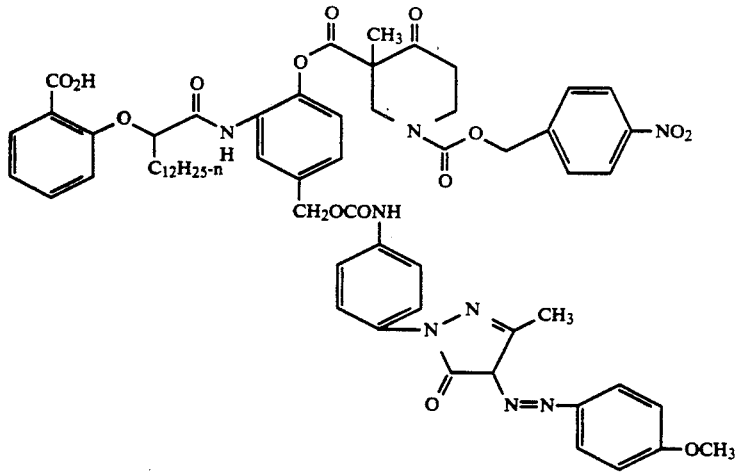
COMPOUND 37
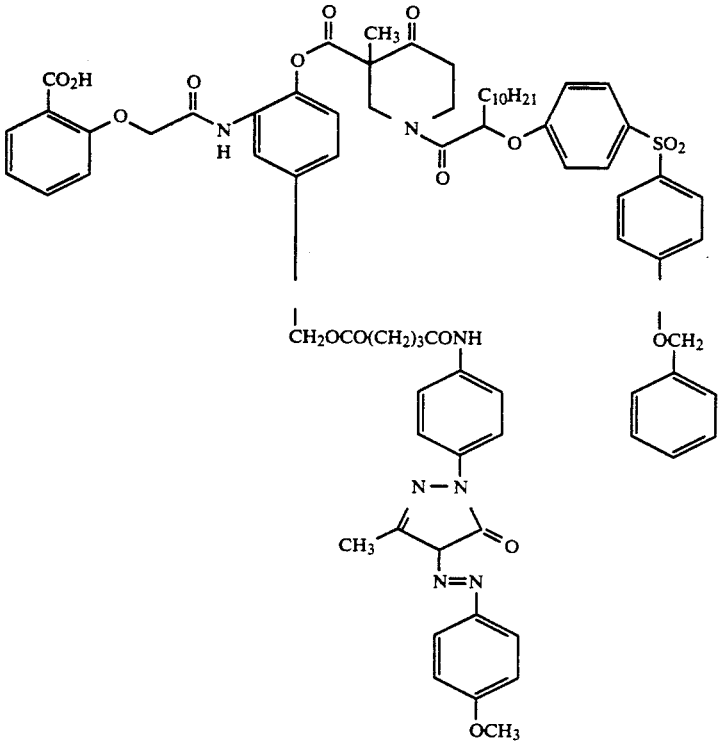
COMPOUND 38.
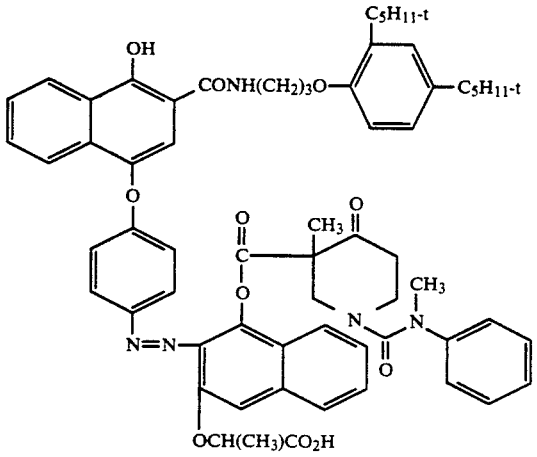

-continued
Compounds having the foregoing or other functions:
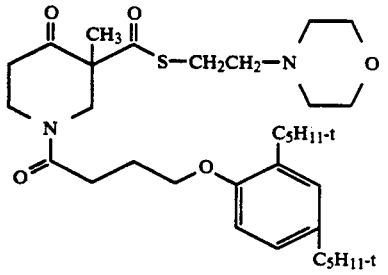
COMPOUND 39.
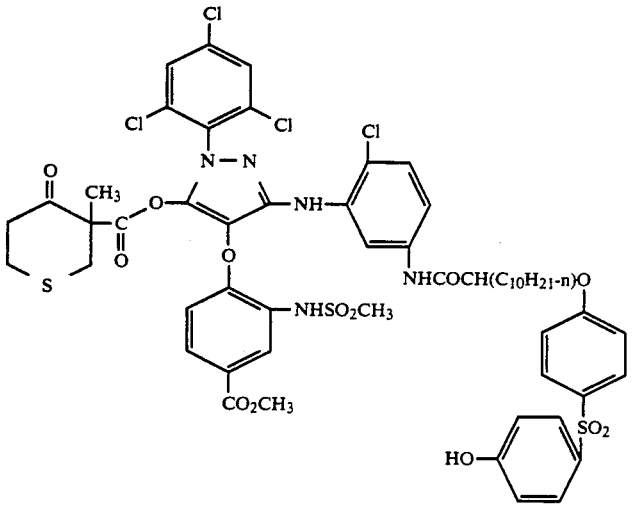
40.
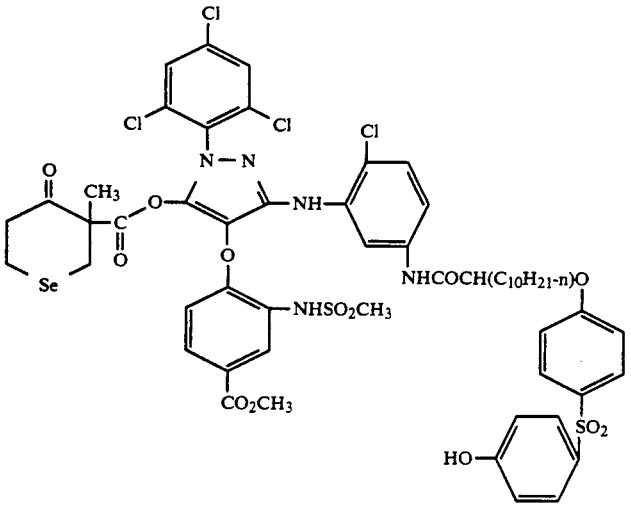
41.

-continued
Compounds having the foregoing or other functions:
42.
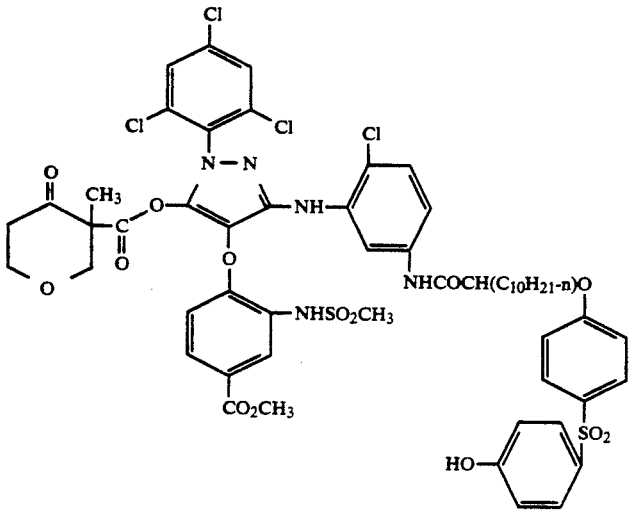
43.
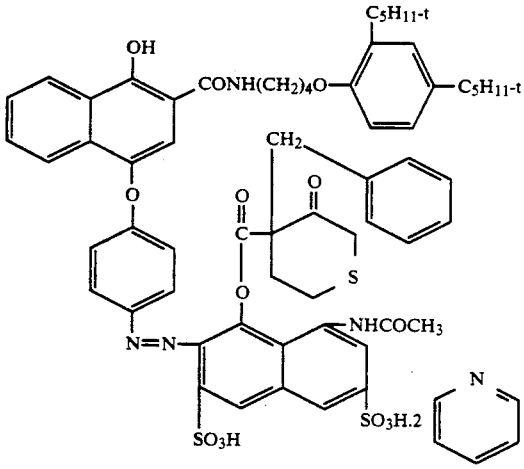
44.
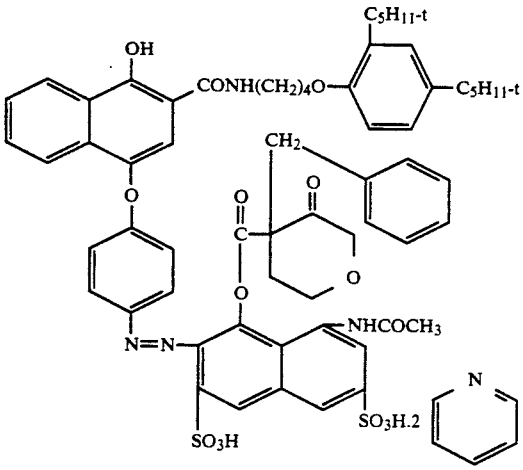

-continued
Compounds having the foregoing or other functions:
45.
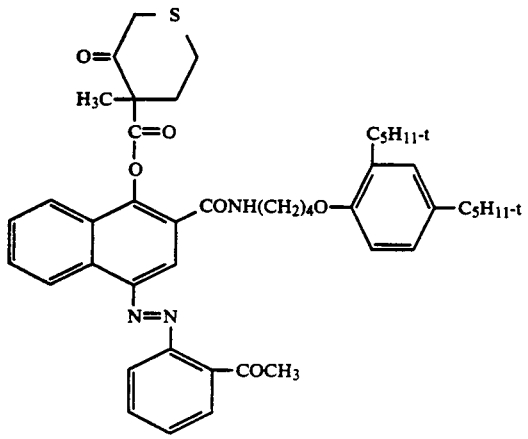
46.
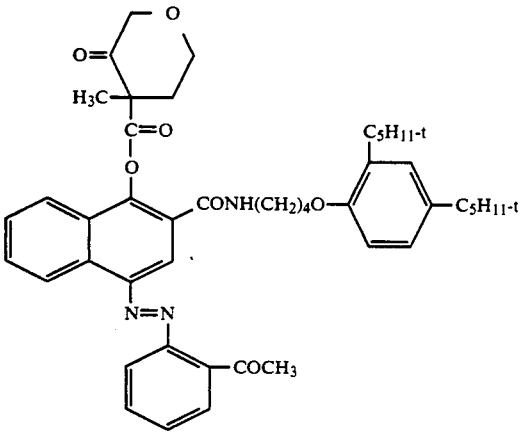
47.
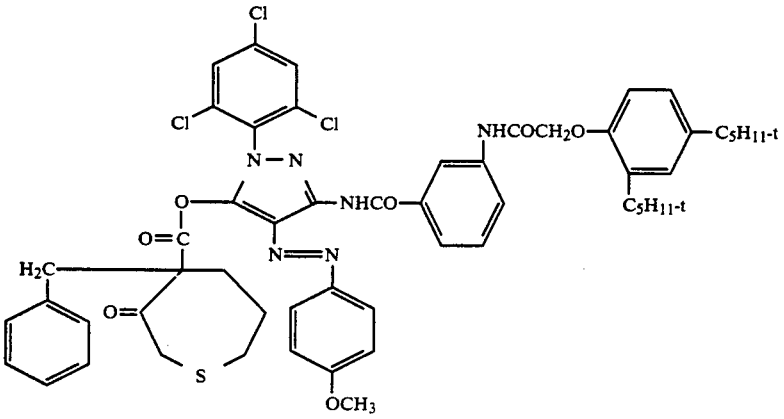

-continued
Compounds having the foregoing or other functions:
48.
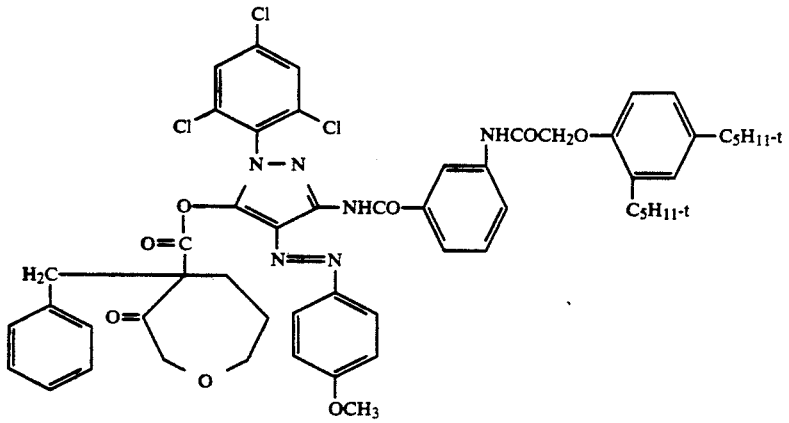
49.
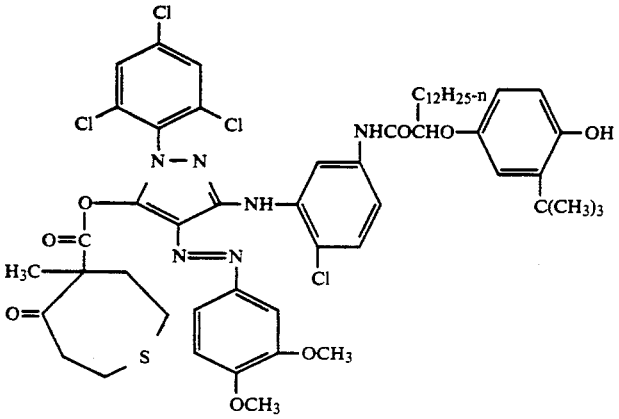
50.
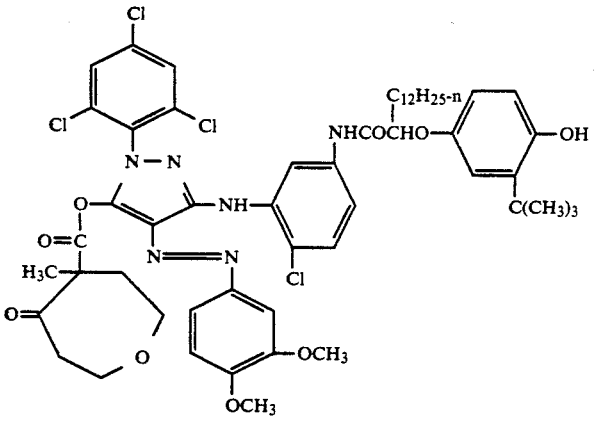
51.
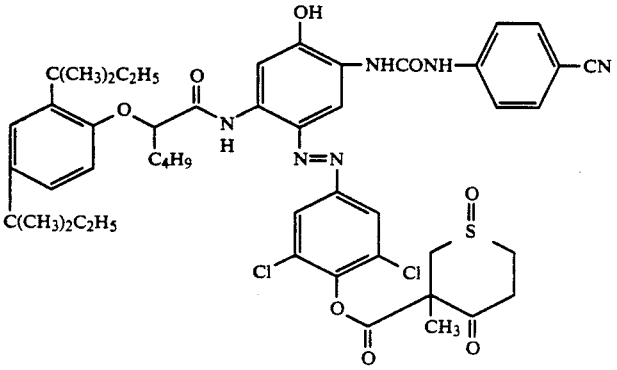

-continued
Compounds having the foregoing or other functions:
52.
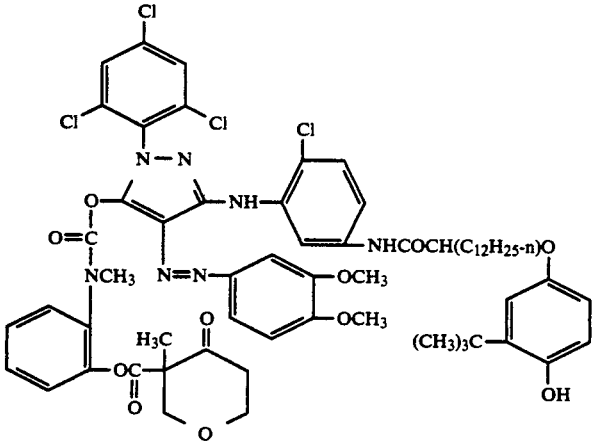
53.
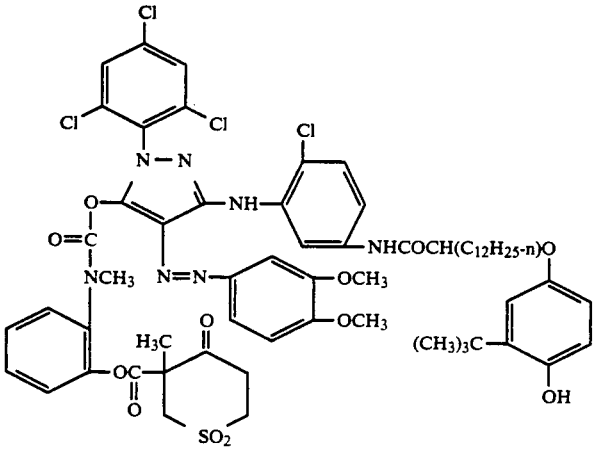
54.
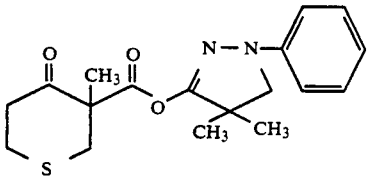
55.
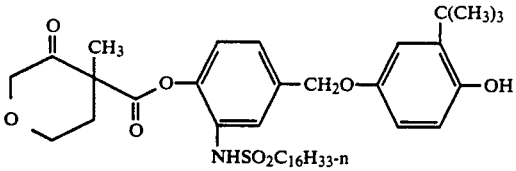
56.
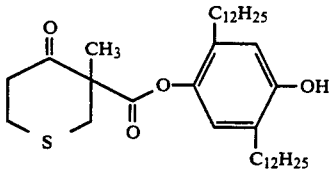
COMPOUND 57.
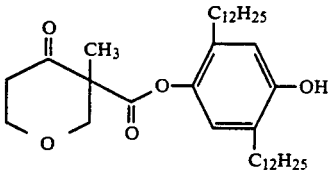

-continued
Compounds having the foregoing or other functions:
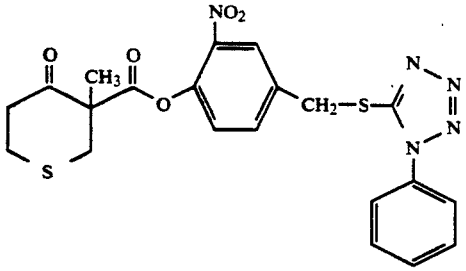
COMPOUND 58.
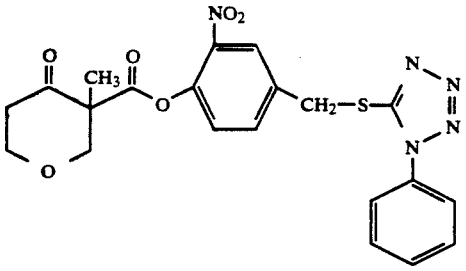
COMPOUND 59.
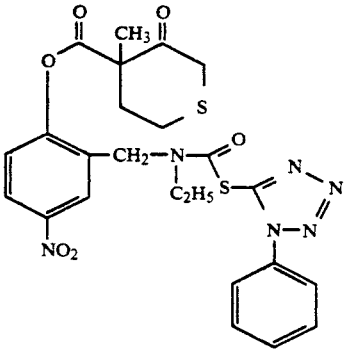
COMPOUND 60.
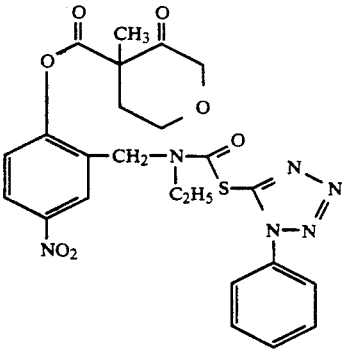
COMPOUND 61.
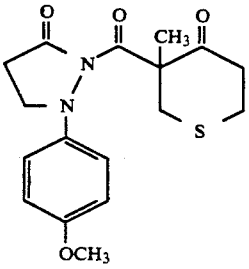
COMPOUND 62.

-continued

Compounds having the foregoing or other functions:

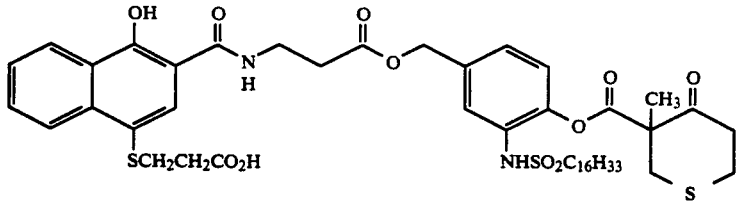

COMPOUND 63.

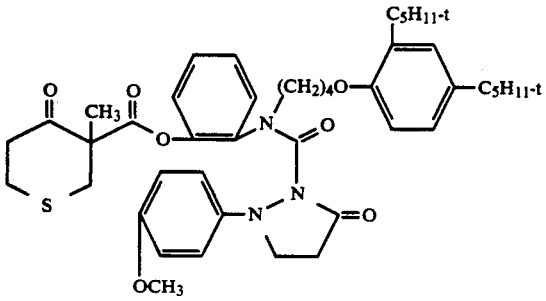

COMPOUND 64.

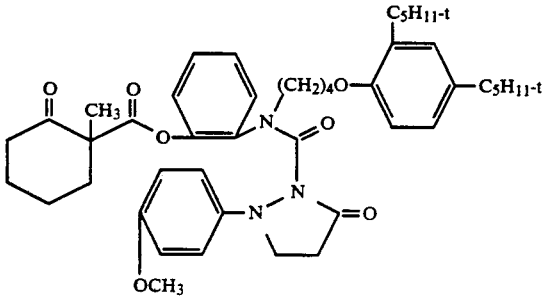

COMPARISON COMPOUND.

EXAMPLE 65

This example demonstrates that the use of a blocking group containing a sulfur atom in accordance with the invention provides a quicker release of the electron transfer agent, as measured by the resulting contrast, speed, and maximum density compared to the identical material without the sulfur atom.

Invention:

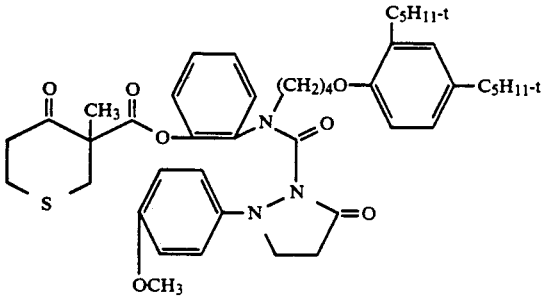

Comparison:

-continued

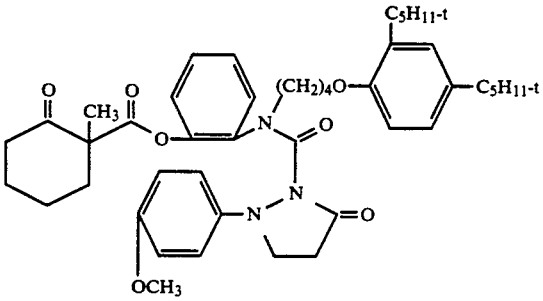

Image Coupler

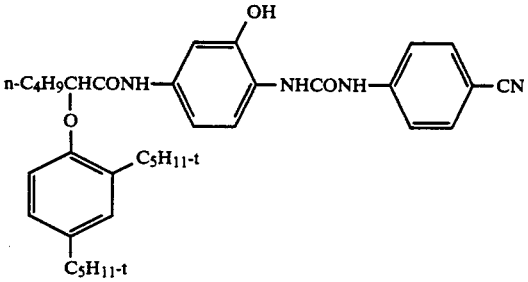

1):
DIAR Coupler (C-2):

-continued

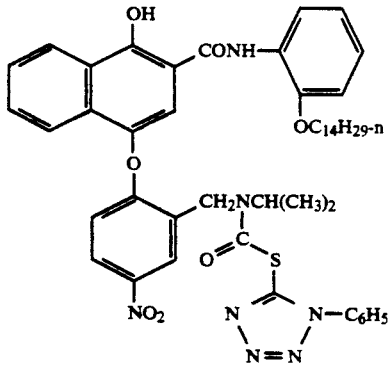

Evaluation Format

The compounds were dispersed using diethyl lauramide (2 parts by weight) and ethyl acetate (3 parts by weight) to prepare a dispersion that was 1% compound (w/w) and 6% gelatin (w/w). A fine particle size dispersion was obtained using a colloid mill, as is well known in the art. The dispersions were used unwashed and included in the emulsion containing a layer of the monochrome test format described below. Other constituents of this layer were gelatin, water, saponin, a red sensitized silver bromoiodide emulsion (3 mole % iodide, tabular grain, 0.75 μm average diameter, 0.13 μm average thickness), an image coupler (C-1) and development inhibitor anchimeric releasing (DIAR) coupler (C-2). Above this was coated a protective overcoat.

| |
|---|
| (OVERCOAT LAYER) |
| Gelatin (5.38 g/m$^2$) |
| 1,1'-[Oxybis(methylene sulphonyl)]bis-ethene (2% of total gelatin) hardener; |
| Saponin (1.5% melt volume |
| (EMULSION LAYER) |
| Gelatin (2.69% g/m$^2$); |
| Saponin (1.5% melt volume); |
| Emulsion (1.61 g Ag/m$^2$); |
| Couplers C-1 (0.54 g/m$^2$), C-2 (0.04 g/m$^2$); |
| +/− electron transfer compound (161 or 269 μmole/m$^2$) |

Samples of these monochrome coatings were imagewise exposed through a graduated density test object and processed at 100 degrees F. using a KODAK C41 protocol modified to include a stop bath (30 sec.). Sensitometric data are shown below:

| COATING | ETA RELEASER μMOLE/M$^2$ | CONTRAST | SPEED | DMAX |
|---|---|---|---|---|
| Invention | 161 | 0.595 | 215 | .930 |
| Invention | 269 | 0.467 | 223 | .807 |
| Comparison | 161 | 0.465 | 211 | .821 |
| Comparison | 269 | 0.358 | 211 | .597 |

This compares the non-imagewise release of ETA from the invention and the comparison without sulfur with the invention results clearly superior.

The invention has been described in detail with particular reference to particular embodiments thereof, but it will be understood that variations and modifications can be effected within the spirit and scope of the invention.

What is claimed is:

1. A photographic element comprising a support bearing at least one silver halide photographic emulsion layer and a blocked photographically useful compound comprising a photographically useful group and a blocking group that is capable of releasing the photographically useful group upon processing the photographic element, wherein the blocking group comprises a beta-ketocarbonyl group that is part of a ring containing a heteroatom selected from the group consisting of nitrogen and sulfur wherein the blocked photographically useful compound is represented by the formula:

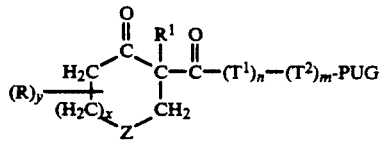

wherein $T^1$ and $T^2$ individually are releasable timing groups;

n and m individually are 0 or 1;

PUG is a photographically useful group;

x is 0, 1 or 2;

$R^1$ is unsubstituted or substituted alkyl;

Z is located at any ring position not adjacent to the ketocarbonyl group; and

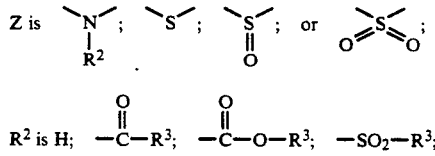

substituted or unsubstituted alkyl or aryl or a photographic ballast group;

$R^3$ is unsubstituted or substituted alkyl, or aryl or

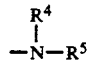

$R^4$ and $R^5$ individually are hydrogen, or unsubstituted or substituted alkyl or aryl;

R is substituted or unsubstituted alkyl or aryl or a photographic ballast group replacing a ring hydrogen; and y is 0, 1, 2 or 3.

2. The photographic element of claim 1 wherein the photographically useful group is a coupler, dye, nucleating agent, development accelerator, inhibitor releasing developer, color developer, development restrainer, antifoggant, bleach accelerator, bleach inhibitor, hardener, silver halide solvent, or precursors thereof.

3. The element of claim 1 wherein the blocked compound is represented by the formula:

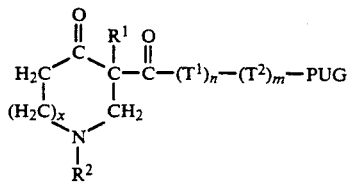

4. The element of claim 3 wherein the blocked compound is represented by the formula:

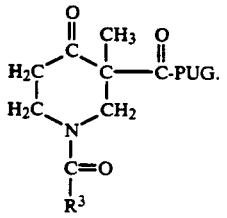

5. The element of claim 3 wherein the blocked compound is one of the following:

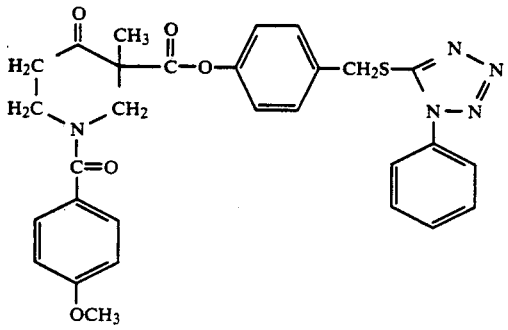

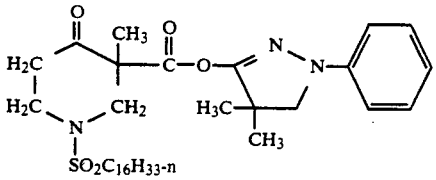

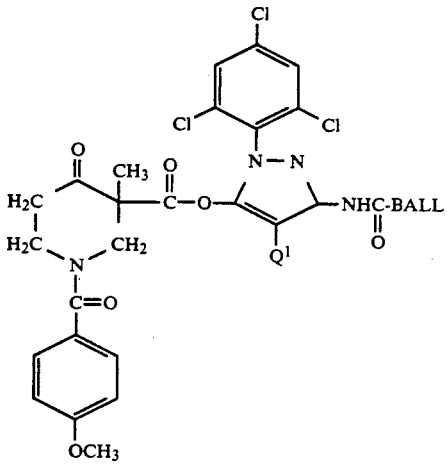

-continued

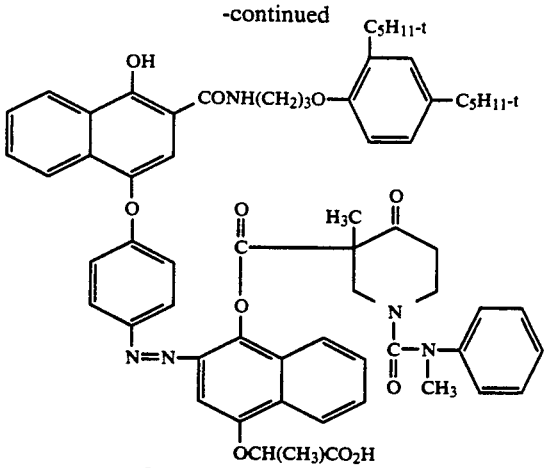

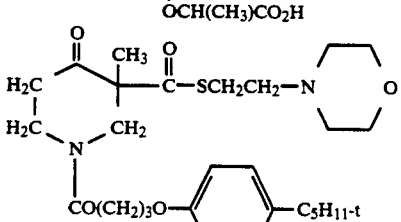

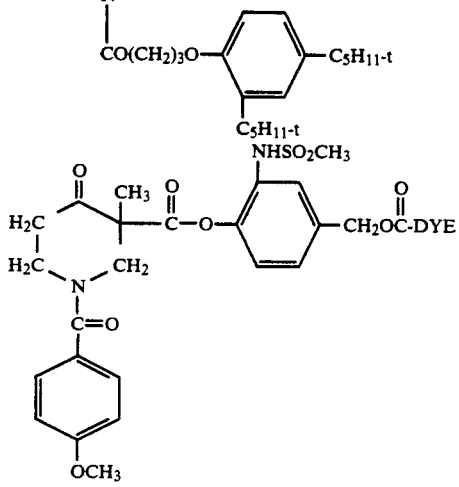

wherein $O^1$ is hydrogen or a coupling-off group;

BALL is a ballast group; and

DYE represents the atoms completing a dye.

6. A photographic element as in claim 1 wherein the blocked photographically useful compound is represented by the formula:

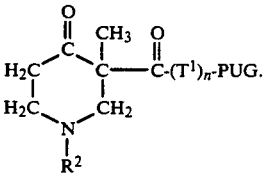

7. The element of claim 1 wherein Z is

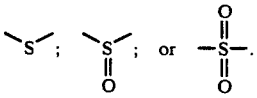

8. A process for developing a photographic image comprising contacting an exposed photographic element as defined in claim 1 with a silver halide color developing agent.

9. The element of claim 3 wherein the blocked compound is selected from the following compound numbers as shown in the specification:

E1 to E3; 3 to 9; and 11 to 39.

10. The element of claim 7 wherein the blocked compound is selected from the following compound numbers as shown in the specification:

10, 40, 43, 45, 47, 49, 51, 53, 54, 56, 58, 60, 62, 63, and 64.

* * * * *

UNITED STATES PATENT AND TRADEMARK OFFICE

CERTIFICATE OF CORRECTION

PATENT NO. : 5,242,783

DATED : Sept. 7, 1993

INVENTOR(S) : John M. Buchanan, et al

It is certified that error appears in the above-indentified patent and that said Letters Patent is hereby corrected as shown below:

In Column 54, Line 53, "clearing" should read --cleating--.

In Column 56, following the fifth structure of claim 5, insert --or--.

In Column 56, Line 43, "$O^1$" should read --$Q^1$--.

Signed and Sealed this

Twenty-second Day of March, 1994

Bruce Lehman

*Attest:*

BRUCE LEHMAN

*Attesting Officer*

*Commissioner of Patents and Trademarks*